US009994432B2

(12) United States Patent
Mahnken et al.

(10) Patent No.: US 9,994,432 B2
(45) Date of Patent: Jun. 12, 2018

(54) HOIST CABLE DRUM WITH AN INTEGRAL BALL SPLINE AND INTERNAL GEAR RING

(71) Applicant: Goodrich Corporation, Charlotte, NC (US)

(72) Inventors: Steven D. Mahnken, Long Beach, CA (US); Bejan Maghsoodi, Diamond Bar, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 316 days.

(21) Appl. No.: 15/072,019

(22) Filed: Mar. 16, 2016

(65) Prior Publication Data

US 2017/0267503 A1 Sep. 21, 2017

(51) Int. Cl.
*B66D 1/14* (2006.01)

(52) U.S. Cl.
CPC ..... *B66D 1/14* (2013.01)

(58) Field of Classification Search
CPC ... B66D 1/14; B66D 1/30; B66D 1/38; B66D 1/39
See application file for complete search history.

(56) References Cited

U.S. PATENT DOCUMENTS 2,943,603 A * 7/1960 Bassinger ..... E21B 4/14 173/1
3,043,444 A * 7/1962 Melton ..... B66C 1/34 212/274
3,807,697 A 4/1974 Cotreau et al.
4,909,482 A 3/1990 Hofmann et al.
5,035,309 A * 7/1991 Takada ..... F16D 15/00 192/41 R
5,052,990 A * 10/1991 Sakakibara ..... F16H 37/021 474/29
5,378,198 A * 1/1995 Moroto ..... F16H 63/062 474/30
5,902,208 A * 5/1999 Nakano ..... F16H 15/38 475/216
2008/0009838 A1 1/2008 Schena
2009/0267406 A1* 10/2009 Thompson ..... B60T 5/00 305/120
2012/0048152 A1* 3/2012 Kim ..... B66D 1/39 108/20
2012/0118208 A1* 5/2012 Kim ..... B66C 21/00 108/20

FOREIGN PATENT DOCUMENTS

CN 203333208 12/2013
DE 102009057240 6/2011
KR 20120008087 1/2012

OTHER PUBLICATIONS

EP Search report dated Oct. 30, 2017 in EP Application No. 17156671.4.

* cited by examiner

*Primary Examiner* — Emmanuel M Marcelo
(74) *Attorney, Agent, or Firm* — Snell & Wilmer L.L.P.

(57) ABSTRACT

A cable drum assembly may comprise a shaft configured to rotate about an axis. A drum may be positioned radially outward from the shaft and configured to rotate about the axis. A ball spline may be in operable communication with the shaft and the drum, the ball spline disposed between the shaft and the drum and configured to orbit the axis.

20 Claims, 7 Drawing Sheets

HOIST CABLE DRUM WITH AN INTEGRAL BALL SPLINE AND INTERNAL GEAR RING

FIELD

The disclosure relates generally to cable spooling machines, and more particularly to a translating hoist cable drum with an integral ball spline and internal gear ring.

BACKGROUND

Hoists are often used to apply pulling force through a lifting medium to a load. Hoists may operate by winding and unwinding a cable about a drum, for example. Hoists may be used in many fields, including air rescue, to raise and lower loads. A hoist employed in air rescue operations may lower a hook to a target and pull the target up to a rescue helicopter. In airborne hoisting environments, hoist mechanisms may reduce efficiency of an aircraft by occupying space and adding weight.

SUMMARY

A cable drum assembly may comprise a shaft configured to rotate about an axis. A drum may be positioned radially outward from the shaft and configured to rotate about the axis. A ball spline may be in operable communication with the shaft and the drum, the ball spline disposed between the shaft and the drum and configured to orbit the axis.

In various embodiments, the shaft may include a track configured to guide a ball bearing of the ball spline in response to an axial translation of the internal hub relative to the shaft. The shaft may also be mechanically coupled to the ball spline by the ball bearing. The track may be configured to transmit a torque to the ball spline through the ball bearing. The track may also extend axially along an outer surface of the shaft. A levelwind shaft may be disposed between the drum and the shaft with the drum configured to move axially in response to rotation of the levelwind shaft. A keying mechanism may be mechanically coupled to the drum and keyed to a groove formed in the levelwind shaft. The keying mechanism may be, for example, slideably engaged with the drum. The keying mechanism may also be retained within a cylindrical opening defined by the drum.

A cable drum assembly may also include a drum comprising an internal hub including a recirculation track for ball bearings. The drum may also be configured to rotate about an axis. A shaft may be configured to rotate about the axis and disposed radially inward from the drum. The shaft may further include an inner surface having gear teeth. The shaft may be mechanically coupled to the internal hub. A levelwind shaft may be disposed between the drum and the shaft with the drum configured to move axially in response to rotation of the levelwind shaft.

In various embodiments, the shaft may include a track configured to guide the ball bearings in response to an axial translation of the internal hub relative to the shaft. The shaft may be mechanically coupled to the internal hub by the ball bearings. The track may be configured to transmit a torque to the internal hub through the ball bearings. The track may also extend axially along an outer surface of the shaft. A keying mechanism may be mechanically coupled to the drum and keyed to a groove formed in the levelwind shaft. The keying mechanism may be slideably engaged with the drum. The keying mechanism may be retained within a cylindrical opening defined by the drum. The drum may also rotate in unison with the shaft in response to a torque applied at the gear teeth of the shaft.

A cable drum assembly may also include a drum including an internal hub with a recirculation track for ball bearings. The drum may rotate about an axis. A shaft may also rotate about the axis. The shaft may be disposed radially inward from the drum with the shaft comprising an inner surface having gear teeth. The shaft may be mechanically coupled to the internal hub. A levelwind shaft may also be disposed between the drum and the shaft. The drum may translate axially in response to rotation of the levelwind shaft. A keying mechanism mechanically coupled to the drum and keyed to a groove formed in the levelwind shaft. In various embodiments, the drum may rotate in unison with the shaft in response to a torque applied at the gear teeth of the shaft.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosures, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosures, it should be understood that other embodiments may be realized and that logical, chemical, and mechanical changes may be made without departing from the spirit and scope of the disclosures. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Hoist systems may incorporate rotating drums to wind and unwind a lifting medium such as cable, rope, or wire, for example. The lifting medium may raise or lower a load in response to the winding or unwinding by the drum. By incorporating the torque delivery mechanism into a ball spline shaft, the weight of and space occupied by a cable drum assembly may be reduced.

Figure 1:
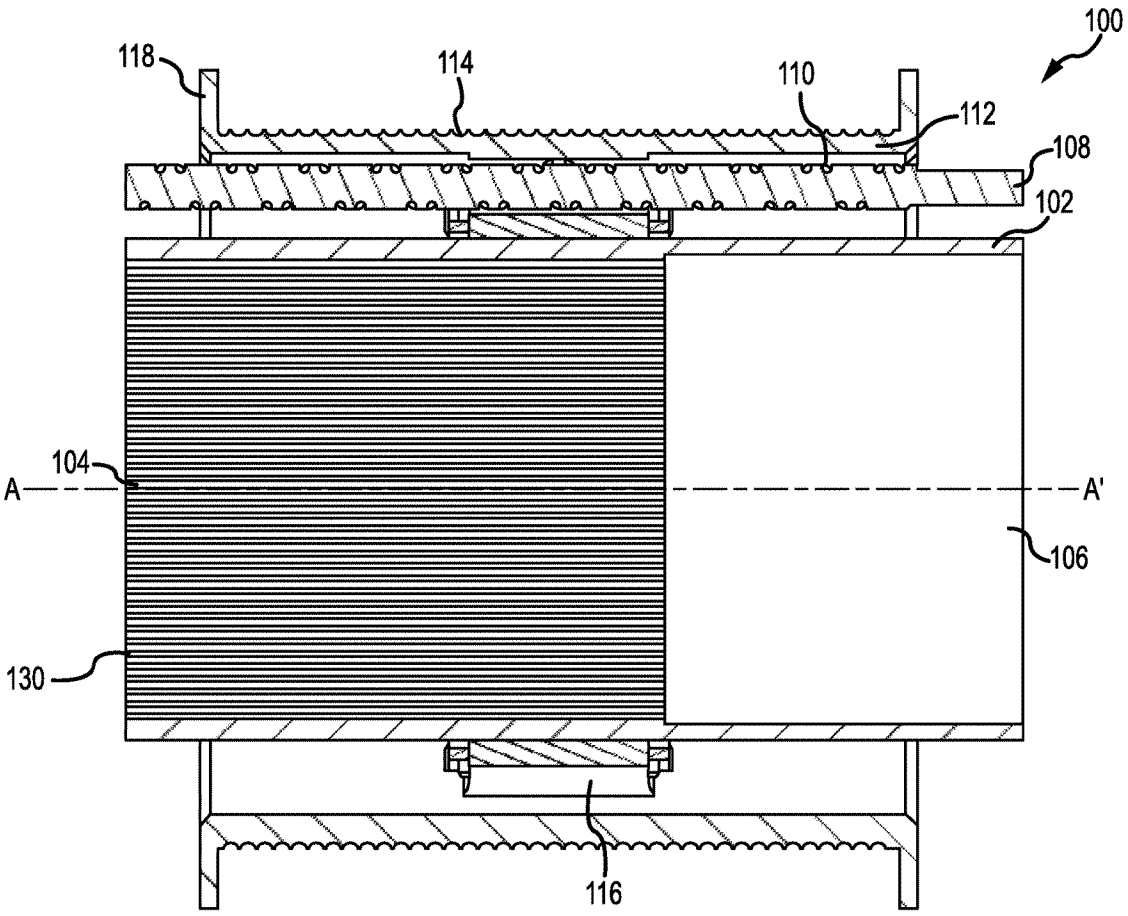
FIG. 1 illustrates a cross sectional view of an annular hoist cable drum having an integral ball spline and internal gear ring with the cross section taken along an axial plane, in accordance with various embodiments.
Figure 2:
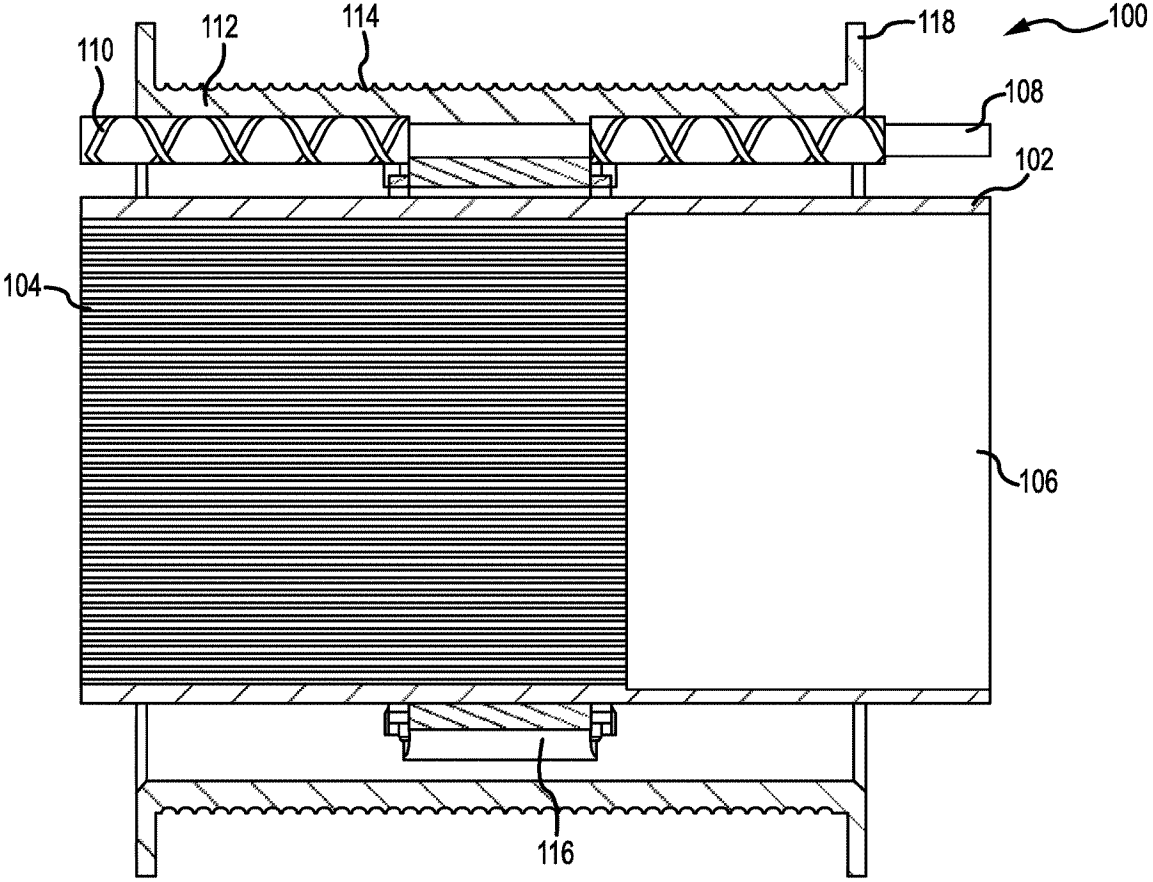
FIG. 2 illustrates a partial cross sectional view of a hoist cable drum having an integral ball spline and internal gear ring and having an levelwind shaft retained in the cable drum hub, in accordance with various embodiments.

With reference to FIGS. 1 and 2, a cable drum assembly 100 is shown having a shaft 102. The shaft 102 may include inner gear 104 integrated into inner surface 106 and comprising teeth 130. Shaft 102 may be configured to rotate about axis A-A' in response to a driving force applied to inner gear 104. For example, inner gear 104 may serve as a ring gear in a planetary gear system. Shaft 102 may comprise an annular geometry or hollowed cylindrical geometry. Other internal interfaces to provide rotational force to shaft 102 may also be used.

In various embodiments, a drum 112 is shown having an annular geometry. Discs 118 may extend radially outward from outer surface 114 to retain a lifting medium such as cable, rope, wire, or other wound medium from sliding axially from outer surface 114. Outer surface 114 may comprise one or more channels configured to receive a lifting medium. Drum 112 may have a hub 116. Hub 116 may also have an annular geometry and be mechanically coupled to shaft 102. For example, hub 116 may be keyed to shaft 102 to enable hub 116 and drum 112 to translate axially relative to shaft 102. Drum 112 may thus rotate about axis A-A' in response to rotation of shaft 102 while translating axially in response to linear motion provided by levelwind shaft 108.

Levelwind shaft 108 may be retained by hub 116 and circumferentially fixed relative to shaft 102. Levelwind shaft 108 may be configured to orbit about the axis A-A' of drum 112 and shaft 102 in response to rotation of drum 112 and shaft 102. Levelwind shaft 108 may also rotate. An actuator or gear system may provide rotational force for levelwind shaft 108. Drum 112 may be keyed to levelwind shaft 108. Drum 112 may thus move in the axial direction in response to the rotation of levelwind shaft 108. In that regard, levelwind shaft 108 may provide linear motion to drum 112. A cable may wind into grooves 115 of outer surface 114 in response to the linear motion and rotational motion of drum 112.

In various embodiments, drum 112 may be made from a metallic material such as aluminum, iron, steel, or other metal with aluminum providing relatively lightweight. Drum 112 may also be made from non-metallic materials such as composite carbon fibers and other molded materials.

Figure 3:
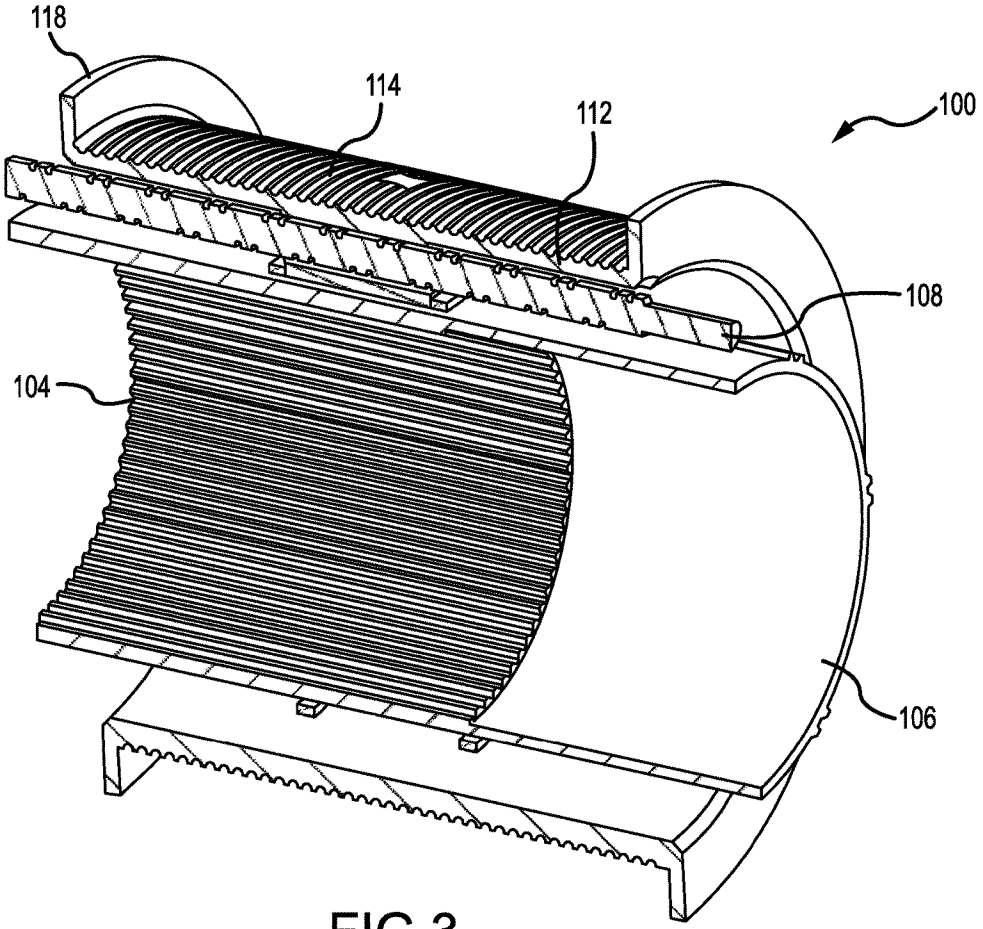
FIG. 3 illustrates a cross-sectional perspective view of a hoist cable drum having an integral ball spline and internal gear ring with the cross section taken along an axial plane, in accordance with various embodiments.
Figure 4:
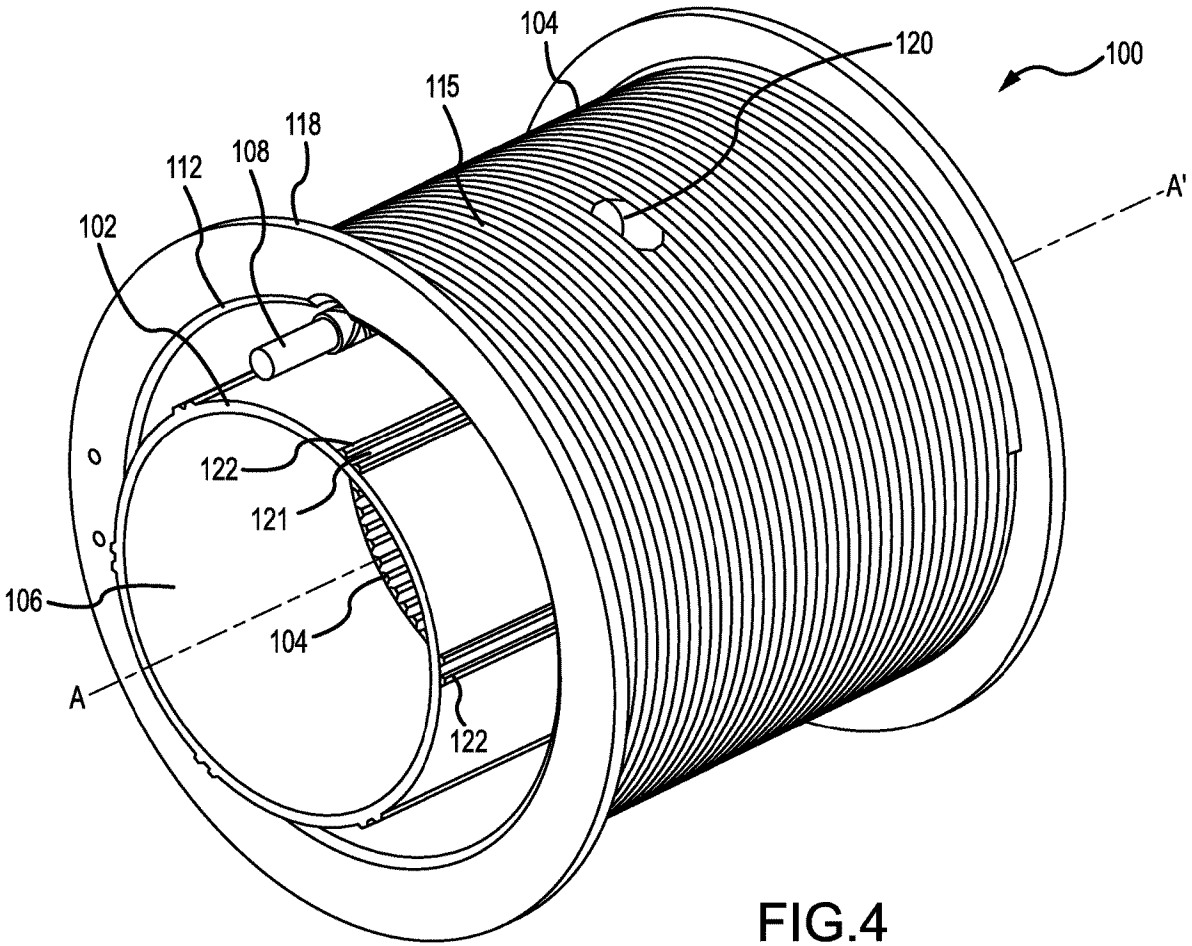
FIG. 4 illustrates perspective view of a hoist cable drum having an integral ball spline and internal gear ring, in accordance with various embodiments.

With reference to FIGS. 3 and 4, cable drum assembly 100 is shown in perspective views according to various embodiments. Outer surface 114 of drum 112 has grooves 115 configured to receive winding a lifting medium. Grooves 115 extend circumferentially about outer surface 114 of drum 112.

In various embodiments, opening 120 defined by drum 112 may be a cylindrical opening configured to receive a key mechanism keyed to grooves 110 of levelwind shaft 108. The cylindrical opening may enable the key mechanism to oscillate in a rotational manner in response to the key mechanism following grooves 110, as described in greater detail below.

Tracks 122 may protrude from an outer surface of shaft 102 to define a groove 121 extending axially along shaft 102. The tracks 122 may interact with ball bearings retained within hub 116. In that regard, tracks 122 may guide ball bearings along the outer surface of shaft 102 in response to hub 116 and drum 112 translating axially relative to shaft 102. Although six (6) tracks 122 are depicted in FIG. 4 as evenly spaced circumferentially about shaft 102, shaft 102 may include any number of tracks 122 and/or spacing arrangements.

Figure 5:
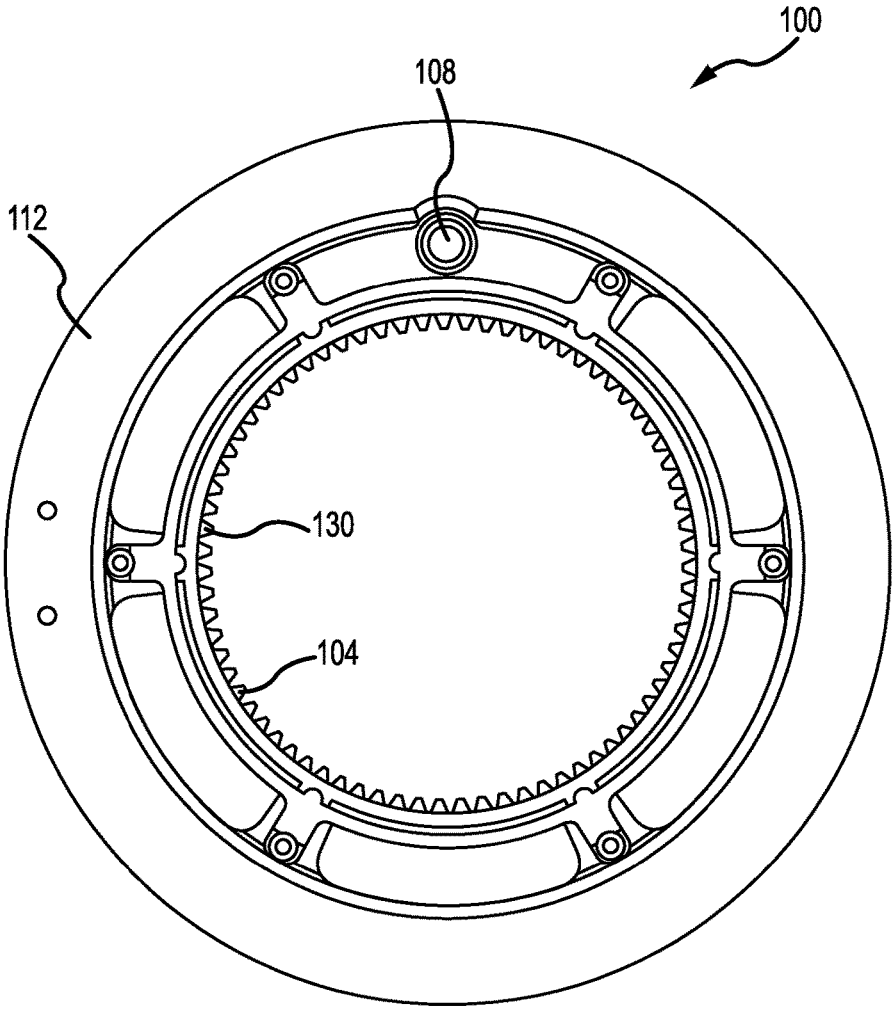
FIG. 5 illustrates an end view of a hoist cable drum having an integral ball spline and internal gear ring, in accordance with various embodiments.

With reference to FIG. 5, an end view of cable drum assembly 100 is shown, in accordance with various embodiments. Teeth 130 protrude radially inward from inner gear 104, which may serve as a ring gear in a planetary gear system, for example. Shaft 102 may be configured to rotate in response to a torque and/or torque applied to shaft 102 at teeth 130. The torque may be communicated through tracks 122 into hub 116 by ball bearings (depicted in FIG. 7) and into drum 112. Shaft 102 and drum 112 may thus rotate in unison in response to the torque applied at the teeth of inner gear 104 of shaft 102.

Figure 6:
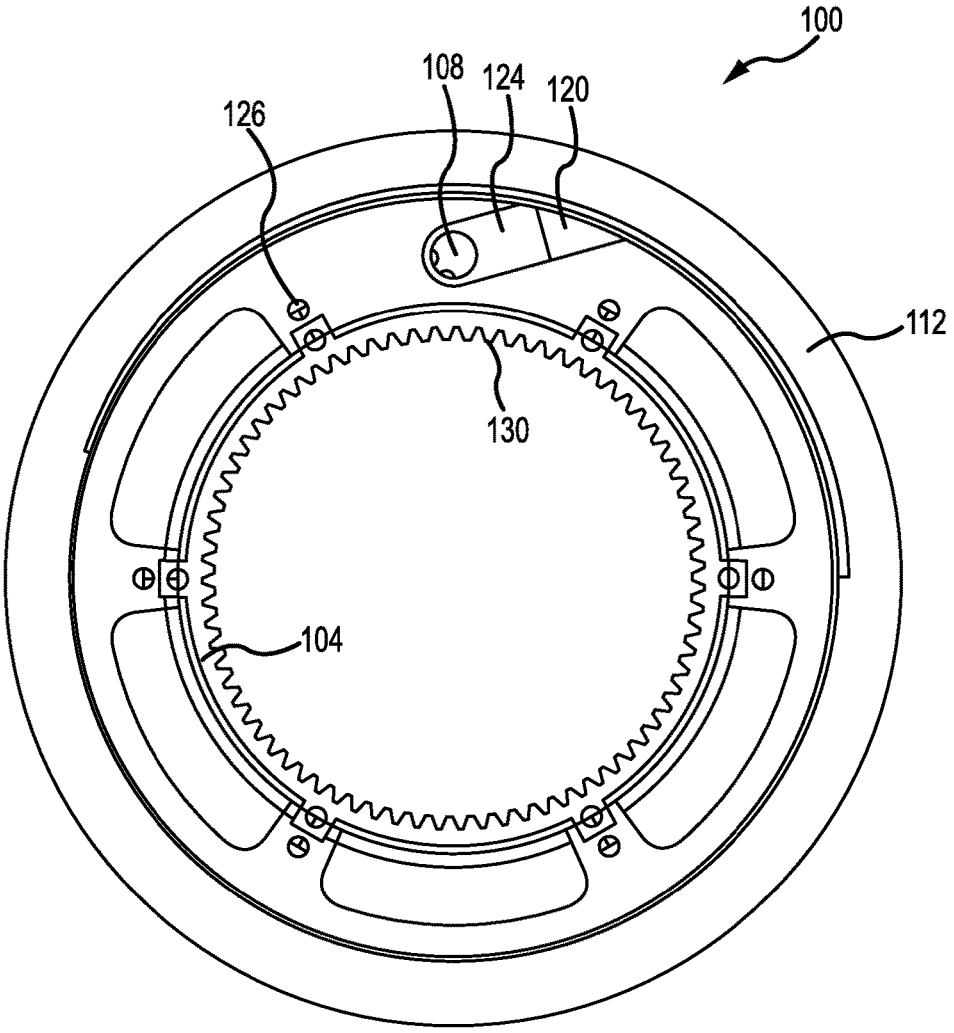
FIG. 6 illustrates a cross-sectional view of an annular hoist cable drum having an integral ball spline and internal gear ring with the cross section taken along a plane perpendicular to the axis of the annular hoist cable drum, in accordance with various embodiments.

Referring now to FIGS. 2 and 6, a cross sectional view of cable drum assembly 100 is shown, in accordance with various embodiments. Keying mechanism 124 may be keyed to levelwind shaft 108 and configured to slideably engage grooves 110 of levelwind shaft 108. In response to rotation of levelwind shaft 108, keying mechanism 124 may press axially (i.e., into and out of the page of illustration) into walls of drum 112 defining opening 120. Drum 112 may translate axially (i.e., into and out of the page of illustration) in response to linear motive force provided by keying mechanism 124 and the rotation of levelwind shaft 108. Keying mechanism 124 may also slideably engage opening 120.

Figure 7:
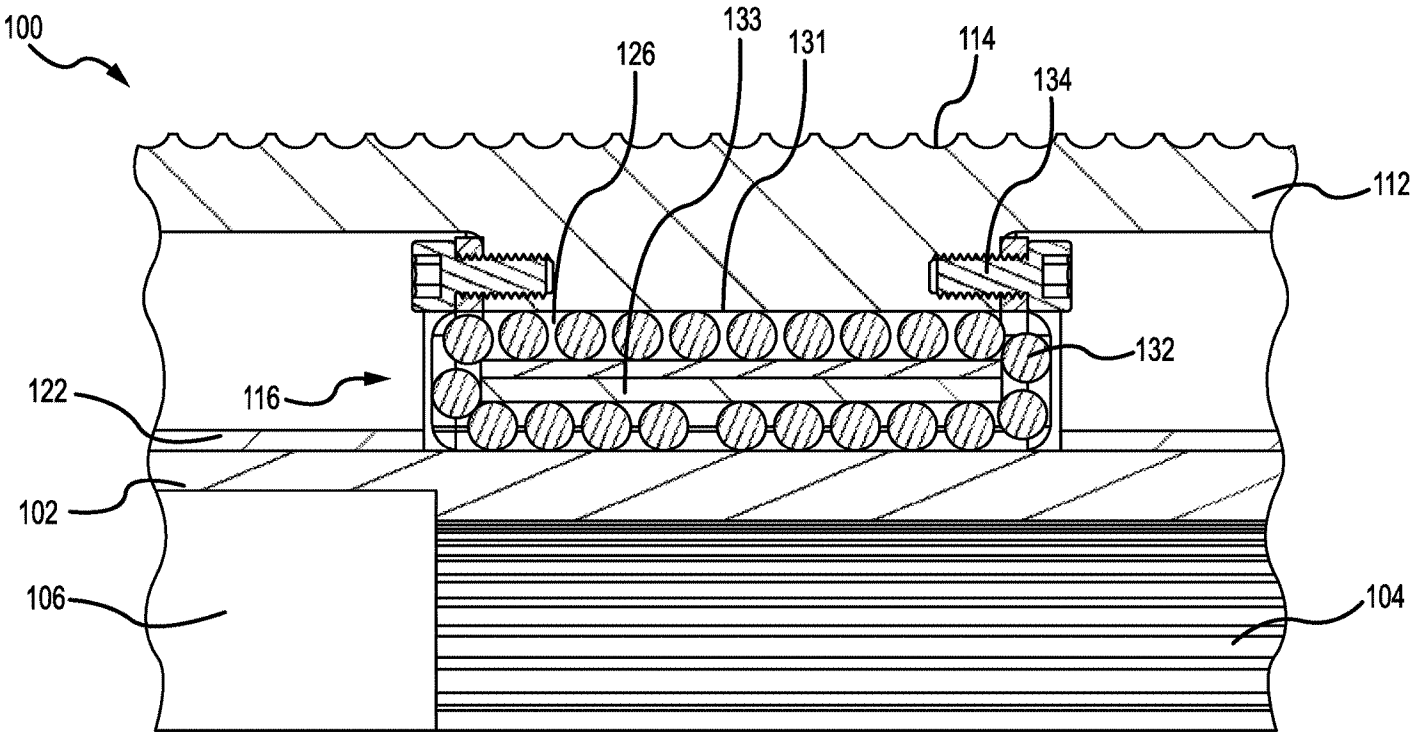
FIG. 7 illustrates cross section of a hoist cable drum having an internal gear ring and an integrated ball spline disposed between the hoist cable drum and the internal gear ring taken along an axial plane, in accordance with various embodiments.

In various embodiments, hub 116 may include recirculation tracks 126 to recirculate ball bearings that interface with tracks 122 of shaft 102 and thereby key hub 116 to shaft 102. Referring now to FIG. 7, a partial cross sectional view of cable drum assembly 100 having integrated ball spline assembly 131, in accordance with various embodiments. With reference to FIGS. 4 and 7, integrated ball spline assembly may recirculate ball bearings 132 around recirculation tracks 126 and tracks 122 formed in the outer surface of shaft 102. Ball bearings 132 may rollably engage tracks 122 and recirculate through recirculation tracks 126 in response to the axial translation of drum 112 and hub 116. Inner track 133 may be formed integrally with drum 112 or formed separately as an insert. Inner track 133 may facilitate load transfer from shaft 102, to ball bearing 132, to inner track 133 and drum 112. A torque may thus be transferred from tracks 122 of shaft 102, through ball bearings 132, and into integrated ball spline assembly 131 of hub 116 and drum 112. Fasteners 134 may retain the axial ends of recirculation tracks 126 by fixing a portion of recirculation tracks 126 to hub 116 of drum 112.

The cable drum assemblies of the present disclosure tend to provide compact hoist mechanisms by integrating an internal gear into the rotatable drive shaft to provide torque to a cable drum. A drive mechanism for the cable drum such as a planetary gear system may thus be housed inside the internal shaft to conserve space. A self-reversing levelwind shaft may be retained between the drum and shaft to provide linear actuation of the drum in an axial direction and wind a lifting medium in an orderly fashion.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosures is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cable drum assembly, comprising:

a shaft configured to rotate about an axis, the shaft comprising an inner surface having gear teeth disposed circumferentially about the inner surface and configured for operable engagement with a driving gear;

a drum positioned radially outward from the shaft and configured to rotate about the axis; and a ball spline in operable communication with the shaft and the drum, the ball spline disposed between the shaft and the drum and configured to orbit the axis.

2. The cable drum assembly of claim 1, wherein at least one of the shaft and the drum comprises a track configured to guide a ball bearing of the ball spline in response to an axial translation of the shaft relative to the drum.

3. The cable drum assembly of claim 2, wherein the shaft is mechanically coupled to the ball spline by the ball bearing.

4. The cable drum assembly of claim 2, wherein the track is configured to transmit a torque to the ball spline through the ball bearing.

5. The cable drum assembly of claim 2, wherein the track extends axially along an outer surface of the shaft.

6. The cable drum assembly of claim 1, further comprising a levelwind shaft disposed between the drum and the shaft, wherein the drum is configured to translate axially in response to rotation of the levelwind shaft.

7. The cable drum assembly of claim 6, further comprising a keying mechanism mechanically coupled to the drum and keyed to a groove formed in the levelwind shaft.

8. The cable drum assembly of claim 7, wherein the keying mechanism is slidably engaged with the drum.

9. The cable drum assembly of claim 7, wherein the keying mechanism is retained within a cylindrical opening defined by the drum.

10. A cable drum assembly, comprising:

a drum comprising an internal hub including a recirculation track for ball bearings, wherein the drum is configured to rotate about an axis;

a shaft configured to rotate about the axis and disposed radially inward from the drum with the shaft comprising an inner surface having gear teeth, wherein the shaft is mechanically coupled to the internal hub; and a levelwind shaft disposed between the drum and the shaft, wherein the drum is configured to translate axially in response to rotation of the levelwind shaft.

11. The cable drum assembly of claim 10, wherein the shaft comprises a track configured to guide the ball bearings in response to an axial translation of the internal hub relative to the shaft.

12. The cable drum assembly of claim 11, wherein the shaft is mechanically coupled to the internal hub by the ball bearings.

13. The cable drum assembly of claim 11, wherein the track is configured to transmit a torque to the internal hub through the ball bearings.

14. The cable drum assembly of claim 11, wherein the track extends axially along an outer surface of the shaft.

15. The cable drum assembly of claim 10, further comprising a keying mechanism mechanically coupled to the drum and keyed to a groove formed in the levelwind shaft.

16. The cable drum assembly of claim 15, wherein the keying mechanism is slideably engaged with the drum.

17. The cable drum assembly of claim 15, wherein the keying mechanism is retained within a cylindrical opening defined by the drum.

18. The cable drum assembly of claim 15, wherein the drum is configured to rotate in unison with the shaft in response to a torque applied at the gear teeth of the shaft.

19. A cable drum assembly, comprising:

a drum comprising an internal hub including a recirculation track for ball bearings, wherein the drum is configured to rotate about an axis;

a shaft configured to rotate about the axis and disposed radially inward from the drum with the shaft comprising an inner surface having gear teeth, wherein the shaft is mechanically coupled to the internal hub;

a levelwind shaft disposed between the drum and the shaft, wherein the drum is configured to translate axially in response to rotation of the levelwind shaft; and a keying mechanism mechanically coupled to the drum and keyed to a groove formed in the levelwind shaft.

20. The cable drum assembly of claim 19, wherein the drum is configured to rotate in unison with the shaft in response to a torque applied at the gear teeth of the shaft.

* * * * *